US008199452B2

(12) United States Patent
Kruska et al.

(10) Patent No.: US 8,199,452 B2
(45) Date of Patent: Jun. 12, 2012

(54) DISCONNECTION ARRANGEMENT AND METHOD FOR OPERATION OF A DISCONNECTION ARRANGEMENT

(75) Inventors: Bernd Kruska, Berlin (DE); Kai Steinfeld, Jiangsu (CN)

(73) Assignee: Siemens Aktiengesellschaft, Munich (DE)

( * ) Notice: Subject to any disclaimer, the term of this patent is extended or adjusted under 35 U.S.C. 154(b) by 504 days.

(21) Appl. No.: 12/447,327

(22) PCT Filed: Oct. 18, 2007

(86) PCT No.: PCT/EP2007/061134

§ 371 (c)(1),
(2), (4) Date: Apr. 27, 2009

(87) PCT Pub. No.: WO2008/049777

PCT Pub. Date: May 2, 2008

(65) Prior Publication Data

US 2010/0051437 A1 Mar. 4, 2010

(30) Foreign Application Priority Data

Oct. 25, 2006 (DE) ..... 10 2006 051 166

(51) Int. Cl.
*H01H 1/00* (2006.01)

(52) U.S. Cl. ..... 361/117; 361/127; 337/30; 200/61.08

(58) Field of Classification Search ..... 361/117, 361/127; 337/30–31; 200/61.08
See application file for complete search history.

(56) References Cited

U.S. PATENT DOCUMENTS

| | | | | |
|---|---|---|---|---|
| 2,305,436 | A * | 12/1942 | Mcmorris | 337/30 |
| 2,481,298 | A * | 9/1949 | Eldridge, Jr. | 337/33 |
| 3,291,937 | A * | 12/1966 | Carothers et al. | 337/30 |
| 4,204,238 | A * | 5/1980 | Stetson | 361/125 |
| 4,663,692 | A | 5/1987 | Carothers et al. | |
| 5,113,167 | A | 5/1992 | Raudabaugh | |
| 5,434,550 | A * | 7/1995 | Putt | 337/31 |
| 6,392,861 | B1 * | 5/2002 | Trinh et al. | 361/117 |
| 6,876,289 | B2 * | 4/2005 | Lenk et al. | 337/30 |
| 7,656,639 | B2 * | 2/2010 | Woodworth et al. | 361/127 |

FOREIGN PATENT DOCUMENTS

CA 347885 A 1/1935

* cited by examiner

*Primary Examiner* — Truc Nguyen
(74) *Attorney, Agent, or Firm* — Laurence A. Greenberg; Werner H. Stemer; Ralph E. Locher

(57) ABSTRACT

A surge arrester is connected in an output current path from an electrical power supply system. A cut-off arrangement is also provided in the output current path and has a first electrode and a second electrode. The second electrode has a recess in which at least part of a gas generator is arranged. The recess is covered by a cover. When the cut-off arrangement responds, an additional volume for accommodation of expanded gas is provided upon demand, in addition to an arcing area provided in the interior of the cut-off arrangement.

9 Claims, 4 Drawing Sheets

Figure 1:
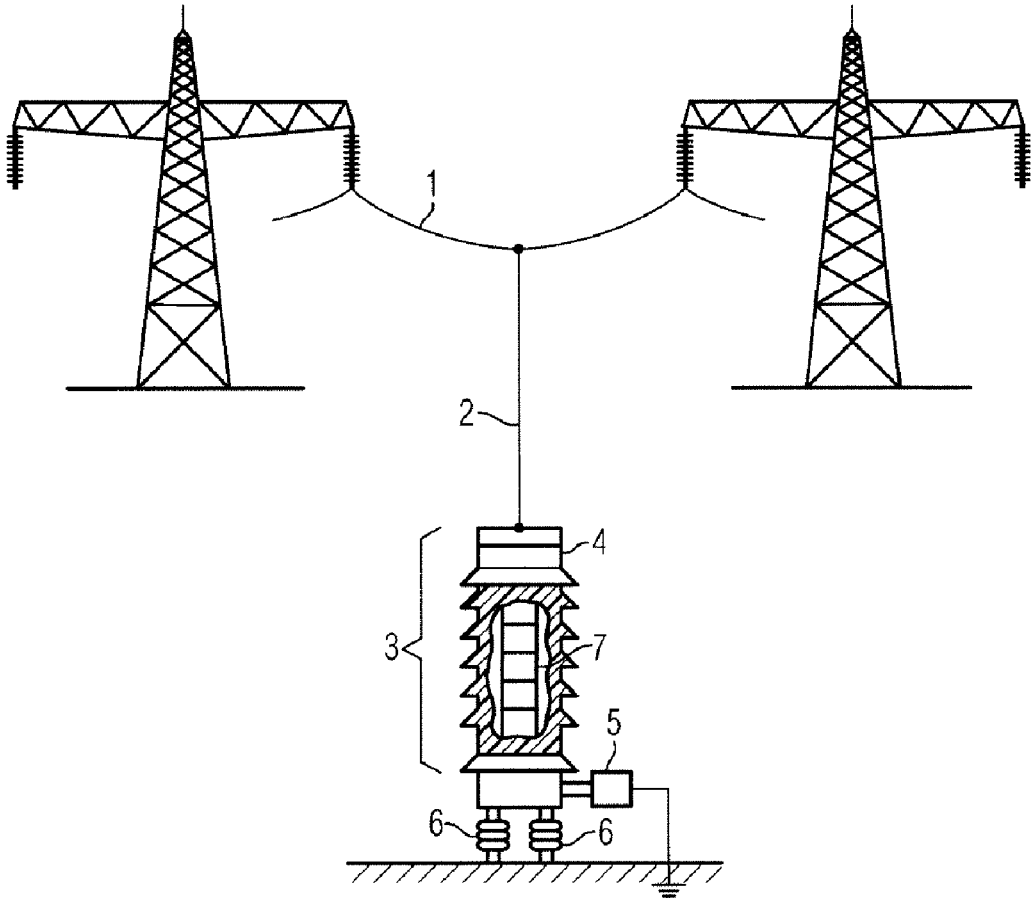

DISCONNECTION ARRANGEMENT AND METHOD FOR OPERATION OF A DISCONNECTION ARRANGEMENT

BACKGROUND OF THE INVENTION

Field of the Invention

The invention relates to a disconnection arrangement having a first electrode and a second electrode, with the second electrode having a recess which at least partially holds a gas generator.

By way of example, a disconnection arrangement such as this is known from Swiss Patent Specification CH 347 885, which describes a surge arrester which is equipped with a disconnection arrangement in order to interrupt current. The disconnection arrangement has a first and a second electrode, which are separated from one another with the recess in the second electrode being overhung partially by the first electrode. The recess is designed such that a gas generator is accommodated in it, with the recess being closed because of the shape of the gas generator. Surrounding the gas generator, the second electrode has a projecting shoulder, such that the projecting shoulder is used as a foot point zone for an arc. The projecting shoulder is intended to protect the gas generator there against arcs flashing over. Furthermore, the prior art describes the fact that other shields can also be provided. Despite the gas-generator shields described in the prior art, the response of the gas generator is relatively imprecise. In consequence, a number of disconnection arrangements of the same type has a comparatively broad tripping response scatter.

BRIEF SUMMARY OF THE INVENTION

The invention is therefore based on the object of specifying a disconnection arrangement which has a better tripping response.

According to the invention, this is achieved in the case of a disconnection arrangement of the type mentioned initially in that the recess is covered by an electrically conductive cover.

The shielding of the gas generator, as known from the prior art by means of an annular field control electrode serves on the one hand to guide an arc of projecting body edges of the second electrode, while on the other hand these body edges are also used to shield the gas generator. This multiple purpose means that compromises have to be made with regard to the design of the body edges.

The provision of a cover according to the invention makes it possible to guide and to steer the foot point of the arc in an enlarged area in the vicinity of the gas generator. This allows the thermal effect of the arc to act on the gas generator in a better manner, preventing direct jumping over to a housing section of the gas generator since the gas generator is located within an area in which there is no field, and the gas generator itself is not part of the shield for the area in which there is no field. It is thus possible to set the response of a disconnection apparatus in a better manner. For certain cases, there is no need for the gas generator to be tripped on operation, that is to say when an arc is struck between electrodes. This is true in particular for relatively low-powered arcs. The power level of an arc is governed by its absolute magnitude and by its time profile. The cover allows arc paths of relatively low-power arcs to be lengthened within the disconnection arrangement, and allows the arcs to be quenched earlier. This is additionally assisted since, because of the cover, a larger volume of electrically conductive material is available, which allows heat to be dissipated quickly. In this case, by way of example, the wall thickness of the cover can be varied in order to adjust the response threshold of the gas generator. It is also possible to use different material combinations and/or alloys for the electrically conductive cover. The provision of an electrically conductive cover is particularly advantageous for disconnection apparatuses in which the gas generator is tripped exclusively by arc effects. Disconnection arrangements such as these are also referred to as a "one-way disconnection arrangement". In contrast to this, an additional heating element is provided on "two-way disconnection arrangements", and can be used to trip the gas generator.

By way of example, explosive capsules containing explosives, for example blank cartridges, can be used as a gas generator. However, it is also possible to use other pyrotechnic elements.

It is advantageously possible to provide for the cover to make electrically conductive contact with the second electrode.

An electrically conductive connection to the second electrode makes it possible to transfer the electrode potential to the cover in a simple manner. For example, it is possible to use the cover as a guide for a foot point of a burning arc. Particularly in the case of a cover which separates the second electrode from an arcing area, it is possible to protect the second electrode against being burnt away. Lower-cost materials can thus correspondingly be used for the electrode material. An alloy material, which is correspondingly resistant to being burnt away, can be used for the volume of the cover, which is smaller than the volume of the second electrode. Furthermore, the provision of a separate cover on the electrode makes it possible to combine the electrode with covers shaped in different ways. Arc paths of different shapes can thus be produced in a simple manner.

A further advantageous refinement makes it possible to provide for the cover to be formed like a shroud.

In addition to the configuration of the cover, for example in a flat, disk-like form, it is advantageous to provide the cover with a recessed area. The recessed area can be used in order to hold an arc foot point in specific areas of the cover and thus to form an arc foot point zone. Furthermore, the shroud-like recessed area in a cover can be used, for example, to center and to position the gas generator. In this case, it is advantageous, for example, for the cover to have a dome-like projection. This dome-like projection may in this case have various shapes. For example, cup-like shrouds can be provided, or it is possible to provide truncated-conical or cylindrical spheres. In this case, it is advantageous to provide the shroud-like area with a peripheral web in order to allow the cover to be positioned and to be fixed. Furthermore, the shroud-like cover makes it possible to split the various volume elements in the interior of the disconnection arrangement. Volume elements can be distributed variably by means of a more or less strongly pronounced shroud shape. For example, volume elements can be compartmentalized which are intended to be used only as required for accommodation, for example, of erosion products of the arc or for temporary accommodation of expanded gases.

A further advantageous refinement makes it possible to provide for the gas generator to be pressed in the recess such that it can move guided with respect to the cover.

Mounting the gas generator such that it can move allows it to be moved while an arc is burning. By way of example, expanded gases can be used for this purpose. The compression of the arc energy to a movement of the gas generator allows a portion of the arc energy to be dissipated in the interior of the disconnection apparatus. For example, the gas generator can be guided in a cylindrical recess in which it can be moved like a piston. By pressing the gas generator against the cover, the gas generator is always arranged, when the disconnection apparatus is in the unoperated state, in the vicinity of the zones which are intended for guidance of the arc. This makes it possible to ensure rapid response times, for example in the case of high-power arcs. In this case, it is advantageous for the gas generator to be pressed against the cover for example by means of an elastically deformable element, such as a helical spring. Furthermore, the contact pressure with the gas generator makes it possible to remove this from the cover, for example in the case of low-power arcs, against the contact-pressure force on the elastically deformable element, and to move the gas generator back to its initial position against the cover again once a low-power arc has decayed. It is thus possible to control the tripping of the disconnection arrangement in a better manner.

A further advantageous refinement makes it possible for the recess to be in the form of a blind hole and to have a widening cross section at its end facing the cover.

As mentioned initially, blank cartridges, which are pushed into the recess, which is in the form of a blind hole, are particularly suitable for use as gas generators. In the bottom area, blank cartridges have a radial flange which is held in the widened cross section of the recess when the blank cartridge is inserted into the recess. This makes it possible to insert the gas generator into the recess such that it is flush. In this case, the widening cross section should extend in its depth in the direction of the bottom area of the recess, which is in the form of a blind hole, such that, when the cartridge is moved in the direction of the blind hole, the opposite end of the blank cartridge indirectly or directly strikes against the bottom of the blind hole before the peripheral collar on the blank cartridge is in place, thus restricting any movement of the blank cartridge, which acts as the gas generator.

It is advantageously also possible to provide for the first electrode to have a first arc foot point zone, and for the cover to have a second arc foot point zone.

Arc foot point zones are used to steer and guide an arc when it is burning. To this end, the arc foot point zones may, for example, have a circular structure, an annular structure, a structure with projections, shroud-like structures, etc. The provision of a respective arc foot point zone on the first electrode and on the cover makes it possible to provide an arcing area for the disconnection arrangement in a comparatively versatile form.

A further advantageous refinement makes it possible to provide for the cover to have a gas channel.

A gas channel on the cover makes it possible to divert a portion of the gas pressure for example through a recess, from the arcing area of the disconnection arrangement. It is thus possible to enlarge the volume of the arcing area of the disconnection arrangement, when necessary, via the gas channel. In addition, the available volume can be enlarged by mounting the gas generator in its recess such that it can be moved in a similar manner to a cylinder, with the gas generator being moved to a greater or lesser extent depending on the magnitude of the gas pressure. The gas generator and gas channel in this case interact like a valve. It is thus possible to damp the influence of the arc. This prevents sudden tripping of the gas generator and allows more accurate tripping of the disconnection arrangement particularly in the boundary area between high-energy arcs, which necessarily cause the immediate tripping of the gas generator, and low-energy arcs, which are in the region of a tripping threshold. The cross section of the gas channel should be smaller than the arc foot point zone which is intended to guide the arc on the cover.

A further advantageous refinement allows the cover to be positioned on an insulating body which separates the two electrodes from one another.

An insulating body can be used to separate and position the two electrodes, including a fixing for the cover. Furthermore, the insulating body can also be designed such that it at least partially bounds the arcing area of the disconnection arrangement. By way of example, hollow-cylindrical insulating bodies can be used for this purpose. In particular, the use of clamping seats and interference fit makes it possible to provide sufficient mechanical robustness for the entire arrangement. Connections formed such as these adequately seal the individual assemblies from one another. Furthermore, it is advantageously possible to provide for the insulating body to have a specific impedance value. This impedance value makes it possible to control the voltage drop across the arc path, in parallel with the arc path. A flashover can therefore be deliberately initiated in the arc path.

It is also possible to provide for a non-reactive resistance to be connected in parallel with the insulating body, and to make electrical contact with the first electrode and the second electrode or the cover element. It is thus possible to set the tripping response of a disconnection arrangement more specifically when using high-impedance insulating bodies. Irrespective of the physical design of the disconnection arrangement, resistance elements connected across the arc path define different types of operating characteristics of the disconnection arrangements.

Furthermore, it is advantageously possible for the first electrode, the second electrode and the insulating body to be embedded in an electrically insulating sheath.

Encapsulation compounds, such as resins or silicones, can be provided as an electrically insulating sheath. These embed the electrodes and the insulating body, and surround these components. It is thus possible to protect the electrodes and the insulating body against external mechanical influences and, for example, to make the disconnection arrangement resistant to open-air use. In addition, the electrically insulating sheath can make the disconnection arrangement mechanically robust. This can be done, for example, at low cost by the use of shrink sleeves which additionally press the individual components against one another and assist the robustness and angular stiffness of the overall arrangement.

A further advantageous refinement allows the two electrodes to be made rotationally symmetrical with respect to a rotation axis, and to be separated from one another at the end, without being coincident.

Rotationally symmetrical electrodes can be manufactured at low cost. Furthermore, rotationally symmetrical bodies have dielectrically good contours. Projecting points and edges are avoided. Disconnection arrangements such as these are therefore also suitable for use in the medium-voltage, high-voltage and very-high-voltage range, that is to say for voltages above 1000 volts, in particular above 10 kV, 30 kV, 70 kV, 145 kV and above. Separation of the two electrodes at the ends allows the arc foot point zones to be arranged opposite at the ends, in such a way that they are opposite in the form of a plate-type capacitor. The electrodes are therefore covered by insulating material in the radial direction in the region of the arcing area. By way of example, this may be the insulating body. This allows better steering and guidance of the arc and prevents premature damage to the gas generator, for example by frequent operation of the disconnection arrangement by low-power arcs. Despite the disconnection arrangement having been operated, this ensures reliable tripping of the disconnection arrangement in the future as well.

A further advantageous refinement allows the disconnection arrangement to be included in an output current path which can be controlled by means of a surge arrester.

Surge arresters are used, for example, in electrical power transmission networks in order to form an output current path to a ground potential when necessary, for example in order to dissipate overvoltages. In this case, the output current path is connected by means of voltage-dependent resistance elements, so-called varistors. The surge arrester is therefore part of the output current path which, for example, runs in the form of a conductor system from parts which are generally live to ground potential. The surge arrester therefore represents a switching element, which can be switched repeatedly, in the output current path. When the disconnection arrangement is included, the disconnection arrangement makes it possible to ensure that permanent disconnection of the output current path is possible, for example, in the event of a short circuit in the surge arrester. To this extent, a disconnection arrangement represents a safety device in order to prevent the formation of a permanent ground-fault current path in an electrical grid system in the event of a fault in the surge arrester.

In this case, the disconnection can be carried out in such a way that tripping can clearly be seen from the outside. By way of example, this can be achieved by the disconnection arrangement being broken down into a plurality of parts when the gas generator trips, such that the response can easily be seen visually, because of this breakdown.

A further object of the invention is to specify a method for operation of a disconnection arrangement which has a first and a second electrode and a gas generator.

Previous methods have had an undifferentiated tripping response, that is to say it is possible to distinguish only to a restricted extent between high-power arcs and low-power arcs in the arcing area of the disconnection arrangement. This results in a relatively coarse tripping pattern, which leads to so-called undifferentiated tripping.

However, it is desirable that every operation of the disconnection arrangement does not lead to tripping of the disconnection arrangement. In this context, the expression operation means that an arc is struck in an arcing area of a disconnection arrangement. Operation such as this takes place, for example, when the surge arrester responds.

One object of the invention is therefore to specify a method which allows more defined tripping of the disconnection arrangement.

According to the invention, in the case of a method of the type mentioned above, this is archived in that:

an arc is struck if a limit voltage is exceeded between a first arc foot point zone and a second arc foot point zone, in that the arc causes gas to expand, in that an additional accommodation volume for the gas is accessible, depending on the expanded gas.

The use of the thermal effect of the arc and of the expansion of gas associated with this in order to provide an additional accommodation volume makes it possible, when necessary, to enlarge the volume that is available to accommodate the expanded gases within the disconnection arrangement.

To this end, it is advantageously possible to move the gas generator on a guide device by means of the gas.

For example, the gas generator may be mounted like a piston in a sliding form in a recess which acts as a guide device, such that the movement of the gas generator opens up the additional accommodation volume for the expanded gas.

Furthermore, it is advantageously possible to trip the gas generator during or after movement of the gas generator.

The gas generator should advantageously be tripped during or after movement of the gas generator. It is thus possible to provide an adequate time window during the movement of the gas generator in order to make it possible to distinguish between low-power arcs, which, although they result in operation of the disconnection arrangement, should actually not cause tripping of the disconnection arrangement, and high-power arcs which would also cause tripping of the disconnection arrangement after operation of the disconnection arrangement. Low-power arcs are not able to introduce sufficient energy into the disconnection arrangement that sufficient energy is available to trip the gas generator even after an enlarged accommodation volume is made available. Low-power arcs expand after additional accommodation volume is released. It is possible to provide, for example, for the accommodation volume to have a variable volume, depending on the strength of the arc. Different chambers can therefore be provided which are connected in steps, or one chamber can be provided which itself allows a volume change by deformation or movement of the walls.

One exemplary embodiment of the invention will be described in more detail in the following text and is illustrated schematically in the drawings, in which:

BRIEF DESCRIPTION OF THE INVENTION

Figure 2:
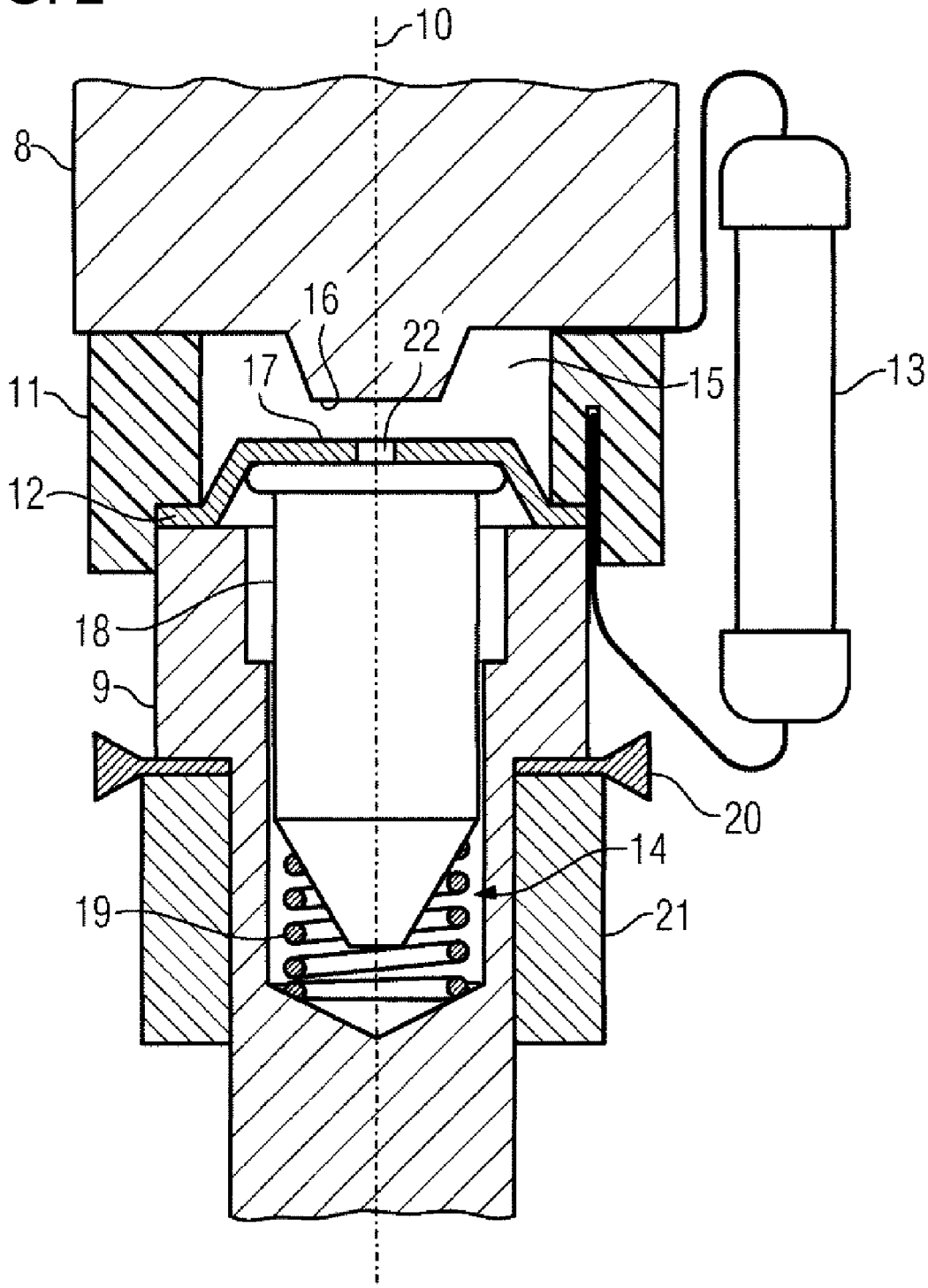
Figure 3:
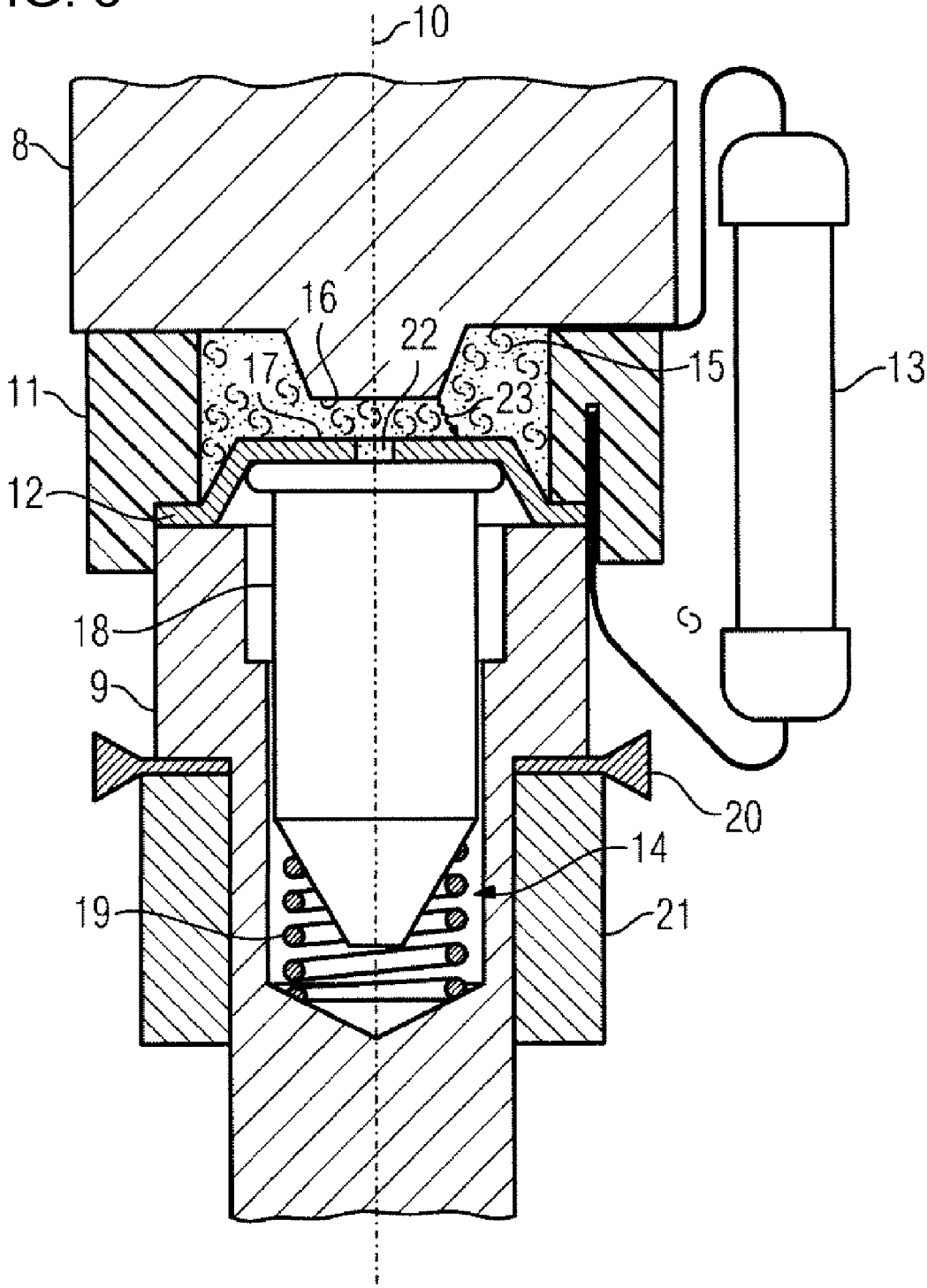
Figure 4:
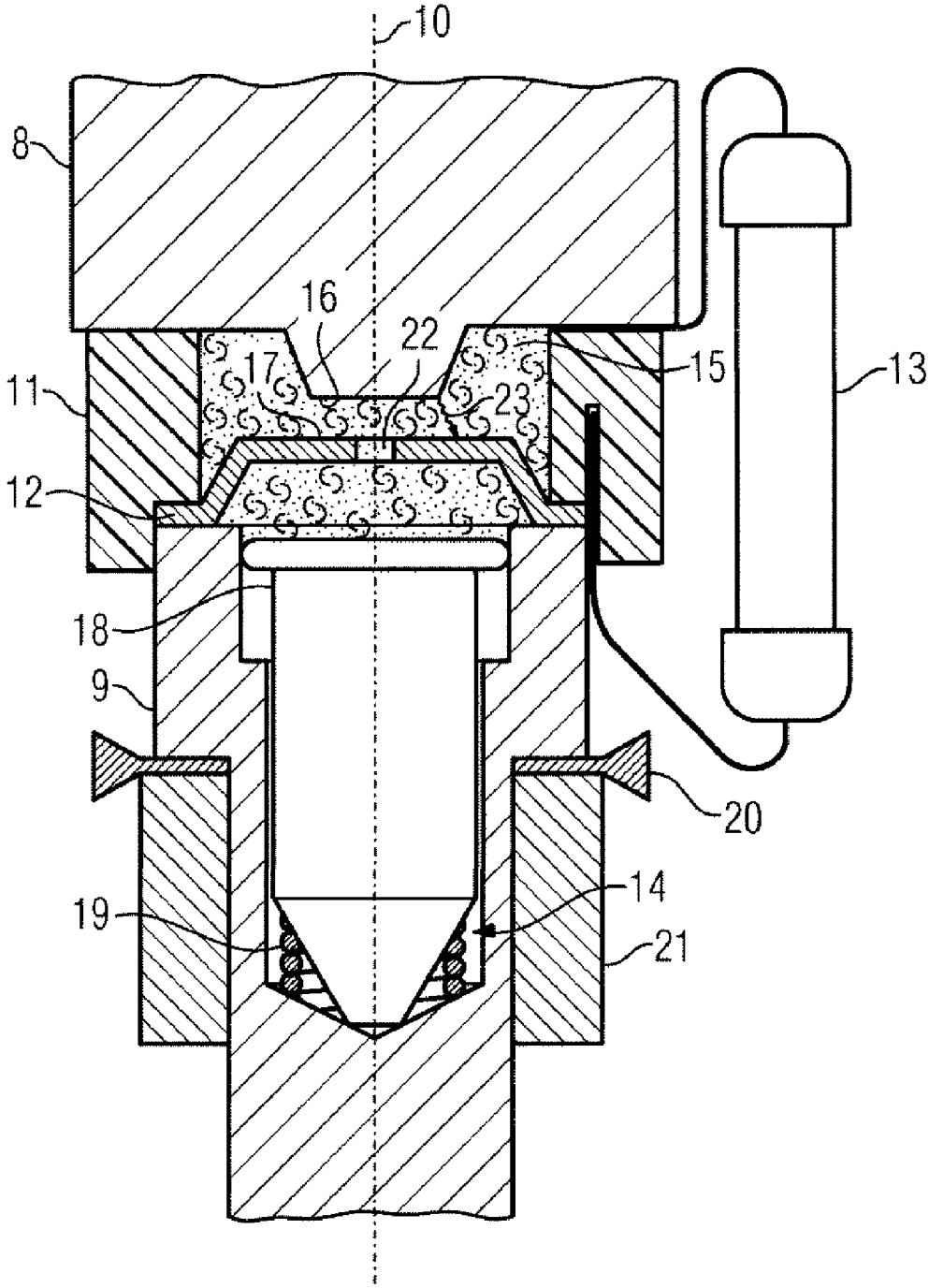

FIG. 1 shows an outline arrangement of a disconnection arrangement on a surge arrester, FIG. 2 shows a section through the disconnection arrangement in the unoperated state, FIG. 3 shows the disconnection arrangement in a first phase of operation of the disconnection arrangement, and FIG. 4 shows the disconnection arrangement in a second phase during operation.

DESCRIPTION OF THE INVENTION

FIG. 1 schematically illustrates an electrical grid system 1. The electrical grid system 1 is, for example, in the form of a high-voltage overhead-line transmission grid system. By way of example, overvoltages can occur in the electrical grid system 1 as a result of switching processes or lightning strikes. An output current path 2 with a ground cable is provided in order to dissipate such overvoltages from a conductor 1 in the electrical grid system 1. In order to prevent a ground fault during normal operation of the electrical grid system a surge arrester 3 is connected in the output current path. The surge arrester 3 may be embodied in many different forms. In the present case, the surge arrester has an electrically insulating housing 4 which, for example, is formed from porcelain or form a plastic composite. By way of example, the housing 4 is essentially tubular and is provided with ribs on its outside, in order to make the surge arrester 3 resistant to outdoor use. At the end, the housing 4 is provided with connecting fittings to which, on the one hand, the ground cable, which comes from the electrical conductor of the grid system, is attached. A disconnection arrangement 5 is attached to the other connecting fittings. The disconnection arrangement 5, likewise part of the output current path 2, carries the output current path 2 further to a ground potential. The more detailed design of the disconnection arrangement 5 and its method of operation will be described in more detail with reference to FIGS. 2 to 4.

A stack of metal-oxide blocks 7 is arranged between the connecting fittings in the interior of the housing 4 of the surge arrestor 3. These metal-oxide blocks 7 are varistors which change their electrical impedance as a function of the voltage applied to them. It is thus possible to switch the output current path 2 on and off repeatedly by means of the surge arrester 3.

In order to prevent current paths in parallel with the disconnection arrangement 5, the surge arrester 3 is installed such that it is electrically isolated from ground potential. Post insulators 6 are provided for this purpose in the present case. However, it is also possible to provide for the surge arrestor to be held, for example, on masts by means of insulating elements which are designed in another appropriate manner.

FIG. 2 shows a section through a disconnection arrangement 5 according to the invention. The disconnection arrangement 5 has a first electrode 8 and a second electrode 9. The electrodes 8, 9 are used to connect the disconnection arrangement 5 in the output current path 2. The two electrodes are rotationally symmetrical and are arranged along their rotation axes 10, with a separation between their ends. An insulating body 11 is provided in order to separate the two electrodes 8, 9, which insulating body 11 is essentially hollow-cylindrical and is likewise aligned coaxially with respect to the rotation axis 10. The second electrode 9 is inserted, with the interposition of a cover 12, into a recess which is circumferential on the internal circumference on the insulating body 11. Furthermore, the insulating body 11 is breached by an impedance element 13, making contact with the first and the second electrodes 8, 9. The impedance element 13 is in the form of a non-reactive resistance. If the insulating material for the insulating body 11 is chosen appropriately, there is no need to use an additional impedance element 13. The cover 12 rests on the second electrode 9 and covers it completely in the direction of the first electrode 8.

The second electrode 9 has a recess 14. The recess 14 is in the form of a blind hole, which is likewise aligned coaxially with respect to the rotation axis 10. The recess 14 has an enlarged cross section at its end facing the first electrode 8. The end of the recess 14 facing the first electrode is covered by the cover 12. In this case, the cover 12 is like a shroud, thus forming a dome which projects in the direction of the first electrode 8. In this case, the dome sphere has an essentially truncated-conical shape. The cover 12 makes electrically conductive contact with the second electrode 9. The projecting dome in the direction of the first electrode 8 reduces the volume of an arcing area 15 which is provided in the region of the insulating body 11. A projection like a truncated cone is integrally formed on the first electrode 8, projecting into the arcing area 15. The projecting dome of the shroud-like cover 12 likewise acts as a truncated cone projecting into the arcing area 15. A first arc foot point zone 16 and a second arc foot point zone 17 are formed on the truncated-conical projections on the first electrode 8 and on the cover 12. The two arc foot point zones 16, 17 in this case have a circular external contour, with the circle planes being aligned at right angles to the rotation axis 10 and being arranged at a distance from one another at the ends.

A gas generator 18 in the form of a blank cartridge is inserted into the recess 14. The gas generator 18 in this case has an essentially cylindrical external contour, being provided with a flange, which enlarges the diameter, in the bottom area. The gas generator 18 is mounted on a helical spring 19 by its end 14 which faces the bottom area of the recess. The helical spring 19 is preloaded and presses the bottom of the gas generator 18 against the cover 12. The cover 12 centers the gas generator 18 and may also have different shapes. The recess 14 is provided with an enlarged diameter at its end facing the first electrode 8. It is thus possible for the radial flange in the bottom area of the gas generator 18 to be moved into the enlarged cross-sectional area when the helical spring 19 is compressed. In this case, that area of the recess 14 which has an enlarged cross section is machined out sufficiently deeply that any further movement is blocked by the recess 14, which is in the form of a blind hole, and the end of the gas generator 19 which faces away from the first electrode 8, before striking the flange on the bottom area of the gas generator 14.

The second electrode 9 has a reduced diameter at its end facing away from the first electrode 8. This results in a projecting shoulder on the second electrode 9, on which a disk element 20 is placed. The disk element 20 is fixed in its position by a clasp 21 on the end of the second electrode 9, which is provided with the reduced diameter. The clasp may, for example, be in the form of a nut which is screwed onto a corresponding thread on that end of the second electrode 9 which is provided with the reduced diameter. Attachments are provided on the external circumference of the disk element 20 and enlarge the surface of the disk element 20. This ensures that an enlarged contact surface area can be achieved when the arrangement illustrated in FIGS. 2 to 4 is embedded in an electrically insulating compound, as a result of which the electrically insulating compound which is intended for embedding adheres in a torsionally stiff manner.

Furthermore, a gas channel 22 is arranged in the cover 12. The gas channel 22 is in the form of a hole which is aligned coaxially with respect to the rotation axis 10. In this case, the diameter of the hole is chosen to be sufficiently small that the bottom area of the gas generator 18 closes the gas channel 22. In order to ensure that the gas channel 22 is closed, the helical spring 19 presses the gas generator 18 against the cover 12.

While FIG. 2 illustrates the disconnection arrangement in the rest state, FIG. 3 illustrates the disconnection arrangement during operation, that is to say the surge arrester 3 has considerably reduced its resistance because a limit voltage has been exceeded in the electrical grid system 1, as a result of which an output current now flows to ground potential via the output current path 2, driven by the grid system overvoltage. The first electrode 8 and the second electrode 9 are part of the output current path 2. The impedance element 13 and/or the insulating body 11 are/is provided in an appropriate form in order to control the potential distribution between the arc foot point zones 16, 17. With appropriate dielectric conditions, an arc 23 is formed between the two arc foot point zones 16, 17. An output current flows. The arc 23 expands gas that is located in the arcing area 15. This increases the pressure in the arcing area 15. If the power of the arc 23 is relatively low and the overvoltage in the electrical grid system has already been dissipated, the arc 23 is quenched. The gas which has expanded in the arcing area 15 gradually cools down again.

However, if this is not the case, then the arc 23 continues to burn, leading to further expansion of gas in the arcing area 15. As the pressure increases, the expanded gas also forces its way through the gas channel 22 and presses against the bottom of the gas generator 18. If the pressure is sufficient, the spring force of the helical spring 19 is overcome, the helical spring 19 is compressed, and the gas generator 18 is moved in its recess 14, which acts as a guide device, in the direction of the bottom of the recess 14 which is in the form of a blind hole. Depending on the strength of the arc 23, the gas generator is moved to a greater or lesser extent from its rest position. If the overvoltage in the electrical grid system has decayed again by this time, that is to say the driving force for the arc 23 is no longer present, the arc 23 is quenched, and the expanded gas cools down. The load on the loaded helical spring 19 is also decreased, and once again forces the gas generator against the cover 12, as a result of which it is possible to assume the initial position as illustrated in FIG. 2.

However, if this is not the case and a voltage still drives an output current, then this leads to the arc continuing to burn, and to further heating of switching gases. As the temperature in the interior of the disconnection arrangement 3 rises, this leads to tripping of the gas generator 18 as a result of the thermal effect, as a result of the pressure effect or as a result of a combination of the two factors. When the gas generator 18 is tripped, the assembly, which is at a rigid angle and originally existed between the two electrodes 8, 9 is tripped, and the output current path 2 is permanently interrupted. The disconnection arrangement 3 is in this case irreversibly broken down into a plurality of parts. When the disconnection apparatus trips, that is to say when the gas generator 18 responds and a very large volume of gas is produced suddenly, associated with this, it is possible for tripping to take place even while the gas generator 18 is being moved by the cover 12. However, it is also possible for tripping to be provided only after the gas generator 18 has reached the final position.

In general, tripping takes place when a fault is present in the surge arrester 3.

The invention claimed is:

1. A disconnection arrangement, comprising:

a first electrode having a first arc foot point zone;

a second electrode, said second electrode having a recess formed therein at least partially holding a gas generator; and an electrically conductive cover covering said recess, said cover having a second arc foot point zone and being disposed in electrically conductive contact with said second electrode.

2. The disconnection arrangement according to claim 1, wherein said cover is formed as a shroud.

3. The disconnection arrangement according to claim 1, wherein said gas generator is movably guided in said recess and pressed against said cover.

4. The disconnection arrangement according to claim 1, wherein said recess is a blind hole with a widened cross section at an end thereof facing said cover.

5. The disconnection arrangement according to claim 1, wherein said cover is formed with a gas channel.

6. The disconnection arrangement according to claim 1, wherein said cover is disposed on an insulating body and said insulating body separates said first and second electrodes from one another.

7. The disconnection arrangement according to claim 6, which comprises an electrically insulating sheath commonly encasing said first electrode, said second electrode, and said insulating body.

8. The disconnection arrangement according to claim 1, wherein said first and second electrodes are formed rotationally symmetrically with respect to a rotation axis and are separated from one another at end faces thereof without an overlap.

9. The disconnection arrangement according to claim 1 incorporated in an output current path that is controlled by way of a surge arrester.

* * * * *